US009297284B2

(12) United States Patent
Oh

(10) Patent No.: US 9,297,284 B2
(45) Date of Patent: Mar. 29, 2016

(54) ENGINE HAVING VARIABLE VALVE TIMING DEVICE

(71) Applicants: Hyundai Motor Company, Seoul (KR); Kia Motors Corporation, Seoul (KR)

(72) Inventor: Chung Han Oh, Seongnam-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 14/338,177

(22) Filed: Jul. 22, 2014

(65) Prior Publication Data

US 2015/0144083 A1 May 28, 2015

(30) Foreign Application Priority Data

Nov. 27, 2013 (KR) ..... 10-2013-0145547

(51) Int. Cl.
*F01L 1/34* (2006.01)
*F01L 1/344* (2006.01)

(52) U.S. Cl.
CPC ..... *F01L 1/3442* (2013.01); *F01L 2001/34453* (2013.01); *F01L 2001/34466* (2013.01)

(58) Field of Classification Search
CPC ..... F01L 1/3442; F01L 2001/34453; F01L 2001/34466
USPC ..... 123/90.15, 90.17
See application file for complete search history.

(56) References Cited

U.S. PATENT DOCUMENTS 5,799,631 A * 9/1998 Nakamura ..... 123/90.17
8,910,602 B2 * 12/2014 Bohner et al. ..... 123/90.17

FOREIGN PATENT DOCUMENTS

JP 2002-357106 A 12/2002
JP 2009-264133 A 11/2009
KR 10-2001-0030066 A 4/2001

* cited by examiner

*Primary Examiner* — Ching Chang
(74) *Attorney, Agent, or Firm* — Morgan, Lewis & Bockius LLP

(57) ABSTRACT

An engine having a variable valve timing device may include a camshaft having a cam that lifts a valve, a valve body with one side fixed with the camshaft and the other side fixed with a fixed housing, variable wings protruding on an outer circumferential surface of the fixed housing, a sprocket housing forming a delay chamber and an advance chamber with the variable wings and having a sprocket on an outer circumferential surface, a control spool disposed coaxially with the camshaft and inserted in the valve body to selectively supply hydraulic pressure from an outside to the delay chamber or the advance chamber, and an actuator fastened to an outer end of the control spool, with a side fixed to a side of the engine, and advancing or delaying the sprocket housing with respect to the valve body by adjusting the hydraulic pressure supplied to the advance chamber or the delay chamber through the control spool by pulling or pushing the control spool.

5 Claims, 6 Drawing Sheets

ENGINE HAVING VARIABLE VALVE TIMING DEVICE

CROSS-REFERENCE TO RELATED APPLICATION

The present application claims priority of Korean Patent Application Number 10-2013-0145547 filed on Nov. 27, 2013, the entire contents of which application are incorporated herein for all purposes by this reference.

BACKGROUND OF INVENTION

1. Field of Invention

The present invention relates to an engine having a variable valve timing device that improves the entire energy consumption efficiency and output by variably controlling the lift timing of an intake valve into advance, middle, and delay states.

2. Description of Related Art

Internal combustion engines generate power by receiving and burning air and fuel in a combustion chamber. When air is sucked, an intake valve is operated by a camshaft and air is sucked into the combustion chamber while the intake valve is open. Further, an exhaust valve is operated by the camshaft, and air is discharged from the combustion chamber while the exhaust valve is open.

However, the optimum opening/closing timings and the open time of the intake valve/exhaust valve depend on the operation conditions such as the RPM or the load of the engine. That is, the appropriate timings for lifting or opening/closing the valves depend on the RPM of the engine.

Technologies of advancing or delaying the lift timing of valves have been proposed, but it is difficult to close an intake valve early, although the lift of the valve is small under a small load at a low speed. Further, it is difficult to close an intake valve late, although the lift of the valve is large under a small load at a high speed.

FIG. 6 is a graph showing a lift of a valve through a variable valve timing device. Referring to FIG. 6, an intake valve is retarded in a starting mode and a high speed/high load mode, and the intake valve is advanced in a low speed/low load mode. Meanwhile, it is impossible to further retard the intake valve in a high speed/high load condition and a low speed/low load condition.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide an engine having a variable valve timing device having advantages of reducing fuel consumption and increasing output by controlling the opening timing of an intake valve with a middle phase in start of the engine, controlling the opening timing of the intake valve with an advance phase under low speed/small load, and controlling the opening timing of the intake valve with a delay phase under high speed and large load. Further, the present invention provides an engine having a variable valve timing device equipped with a control structure for controlling the opening timing of an intake valve into advance, middle, and delay states.

Various aspects of the present invention provides an engine having a variable valve timing device, which may include: a camshaft having a cam that lifts a valve; a valve body with one side fixed with the camshaft and the other side fixed with a fixed housing; variable wings protruding on an outer circumferential surface of the fixed housing; a sprocket housing forming a delay chamber and an advance chamber with the variable wings and having a sprocket on an outer circumferential surface; a control spool disposed coaxially with the camshaft and inserted in the valve body to selectively supply hydraulic pressure from an outside to the delay chamber or the advance chamber; and an actuator fastened to an outer end of the control spool, with a side fixed to a side of the engine, and advancing or delaying the sprocket housing with respect to the valve body by adjusting the hydraulic pressure supplied to the advance chamber or the delay chamber through the control spool by pulling or pushing the control spool.

The device may further include a cylinder head where the valve body is disposed, and an advance channel and a delay channel through which the hydraulic pressure is supplied to the advance chamber and the delay chamber, respectively, may be formed in the cylinder head. Locking pins that selectively lock the fixed housing and the sprocket housing may be disposed in the fixed housing or the sprocket housing.

The device may further include a cylinder head rotatably supporting the valve body, wherein a locking pin channel through which the hydraulic pressure is transmitted to the locking pins may be formed in the cylinder head and the control spool may selectively transmit the hydraulic pressure to the locking pins in accordance with a position of the sprocket housing. The locking pins may fix the sprocket housing in a middle position between a delay position and an advance position.

The actuator may be fixed to a side of a chain cover protecting a chain wound around the sprocket.

The device may further include an inner cover covering a camshaft side of the sprocket housing, an outer cover covering a side opposite to the inner cover of the sprocket housing, and an elastic member elastically supporting the sprocket housing in a delay or advance direction with respect to the outer cover.

According to the present invention, since the actuator on the chain cover pulls or pushes the control spool in the valve body rotating with the camshaft, the transmission path of hydraulic pressure to the valve body is changed, such that the sprocket housing can be advanced or delayed and can be fixed to the camshaft at a middle phase between the advance and delay positions.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
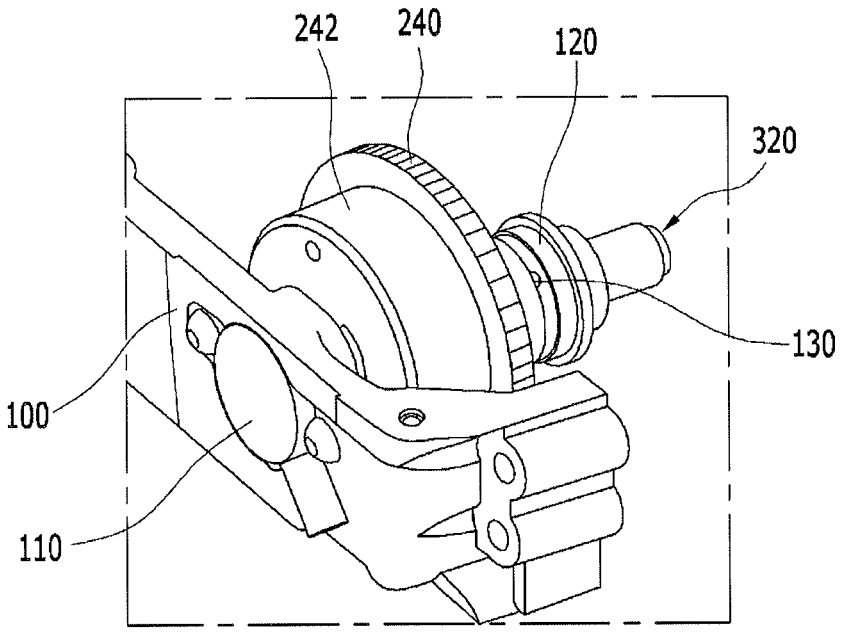
FIG. 1 is a schematic perspective view showing a portion of an exemplary engine having a variable valve timing device according to the present invention.

FIG. 1 is a schematic perspective view showing a portion of an engine having a variable valve timing device according to various embodiments of the present invention. Referring to FIG. 1, the engine having a variable valve timing device includes an actuator 110, a chain cover 100, a sprocket housing 242, a sprocket 240, a valve body 120, and a camshaft 320.

The camshaft 320 is fixed to a side of the valve body 120 and the sprocket housing 242 is disposed at the other side of the valve body 120.

The chain cover 100 is fixed outside the sprocket housing 242 and the actuator 110 is fixed to the chain cover 100. The sprocket 240 transmits torque from a crankshaft through a chain to the camshaft 320.

As the actuator 110 on the chain cover 100 pulls or pushes a control spool 420 (FIG. 4), the sprocket housing 242 is advanced, delayed, or fixed to a middle position between the advance and delay positions with respect to the camshaft 320 and the valve body 120, such that the lift timing of a valve is variably controller.

Figure 2:
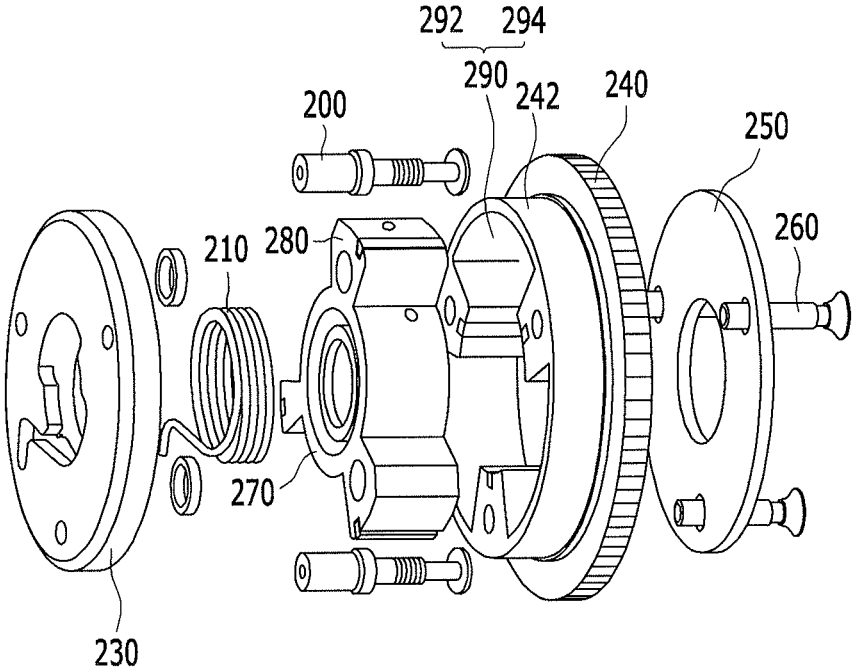
FIG. 2 is a partial exploded perspective view showing an exemplary engine having a variable valve timing device according to the present invention.

Further, the actuator 110 fixes the sprocket housing 242 to the camshaft 320 at the middle position between the advance and delay positions by adjusting the amount of pulling or pushing the control spool 420 (FIG. 4) and adjusting the hydraulic pressure supplied to a locking pin 200 (FIG. 2).

Accordingly, hydraulic pressure transmission holes 130 that selectively adjust hydraulic pressure to the delay angle chamber, the advance angle chamber, and the locking pin 200 are formed in the valve body 120.

FIG. 2 is a partial exploded perspective view showing an engine having a variable valve timing device according to various embodiments of the present invention. Referring to FIG. 2, the engine having a variable valve timing device includes fastening bolts 260, an inner cover 250, the sprocket 240, the sprocket housing 242, hydraulic chambers 290, locking pins 200, variable wings 280, a fixed housing 270, an elastic member 210, and an outer cover 230.

The fixed housing 270 is fixed to the valve body 120 and a plurality of variable wings such as three variable wings 280 protrude on the outer circumferential surface.

A plurality of hydraulic chambers such as three hydraulic chambers 290 are formed in the sprocket housing 242 to correspond to the variable wings 280 and the variable wings 280 are disposed in the hydraulic chambers 290. Thus, the hydraulic chambers 290 is divided by the variable wing 280 into a delay chamber 292 and an advanced chamber 294.

The hydraulic chambers 290 are divided into an advance chamber and a delay chamber around the variable wings 280. When hydraulic pressure is supplied to the advance chamber, the sprocket housing 242 is advanced with respect to the camshaft 320, and when hydraulic pressure supplied to the delay chamber, the sprocket housing 242 is delayed with respect to the camshaft 320.

The inner cover 250 is mounted on the inner side of the sprocket housing 242 the outer cover 230 is mounted on the outer side, and the fixed housing 270 and the variable wings 280 are disposed between the inner cover 250 and the outer cover 230.

The locking pins 200 are provided to fix the variable wings 280 of the fixed housing 270 and the sprocket housing 242 together. The locking pins 200 fix the variable wings 280 and the sprocket housing 242 at a middle position between the advance and delay positions in accordance with the supplied hydraulic pressure.

The elastic member 210 is disposed in the fixed housing 270 and increases the response speed on advance/delay control by applying an elastic force for advancing or delaying the outer cover 230, the sprocket housing 242, and the inner cover 250 with respect to the fixed housing 270.

The fastening bolts 260 fix the inner cover 250, the sprocket housing 242, and the outer cover 230 together. Accordingly, the inner cover 250, the sprocket housing 242, and the outer cover 230 move as one body, and the fixed housing 270, the valve body 120, and the camshaft 320 move as one body.

Figure 3:
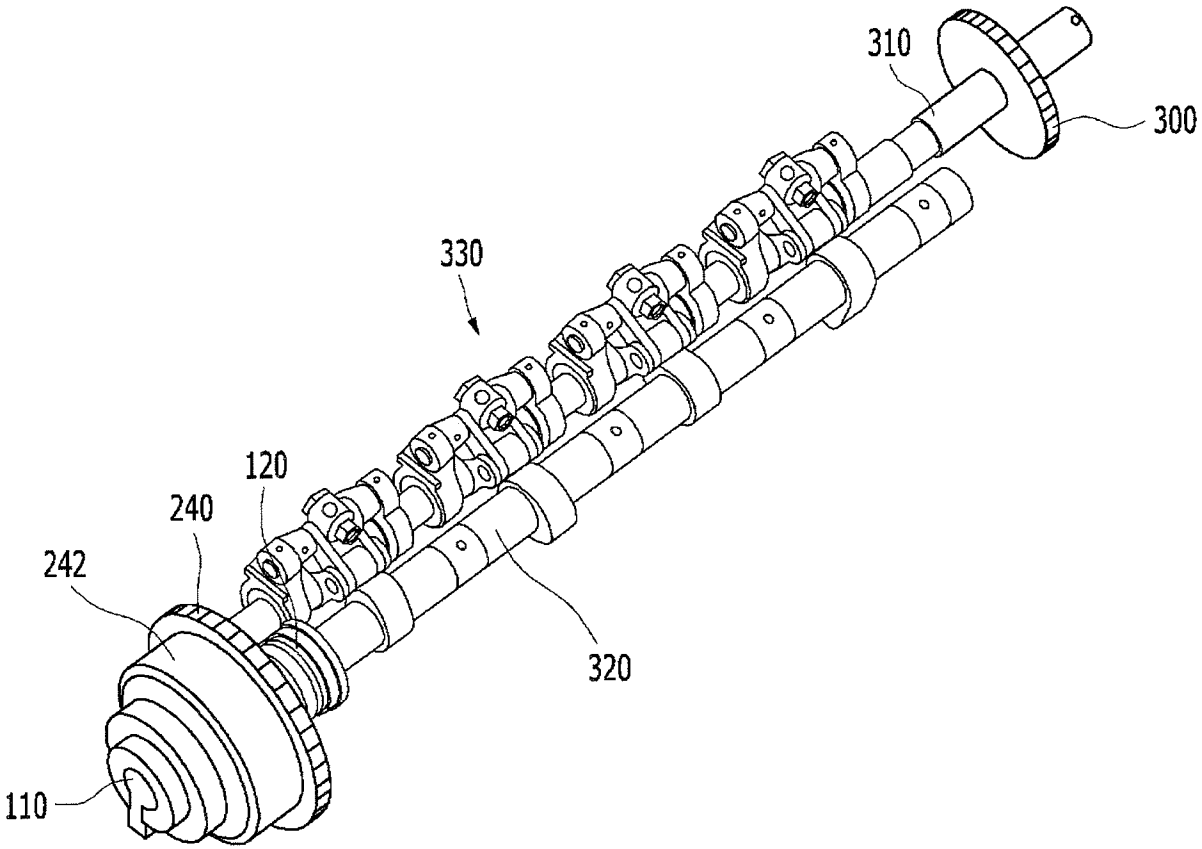
FIG. 3 is a partial perspective view showing an exemplary engine having a variable valve timing device according to the present invention.

FIG. 3 is a partial perspective view showing the engine having a variable valve timing device according to various embodiments of the present invention. Referring to FIG. 3, the variable valve timing device includes the camshaft 320, the valve body 120, the sprocket 240, the sprocket housing 242, the actuator 110, a variable valve lift shaft 310, a variable valve lift mechanism 330, and a worm wheel 300, in which as a worm gear rotates the variable valve lift shaft 310 through the worm wheel 300, the variable valve lift mechanism 330 operates and adjusts the lift height of a valve.

The camshaft 320 lifts the valve not directly, but through the variable valve lift mechanism 330. In various embodiments of the present invention, a variable valve timing mechanism and a variable valve lift mechanism are used, such that the lift timing and the lift height of the valve can be simultaneously adjusted.

Figure 4:
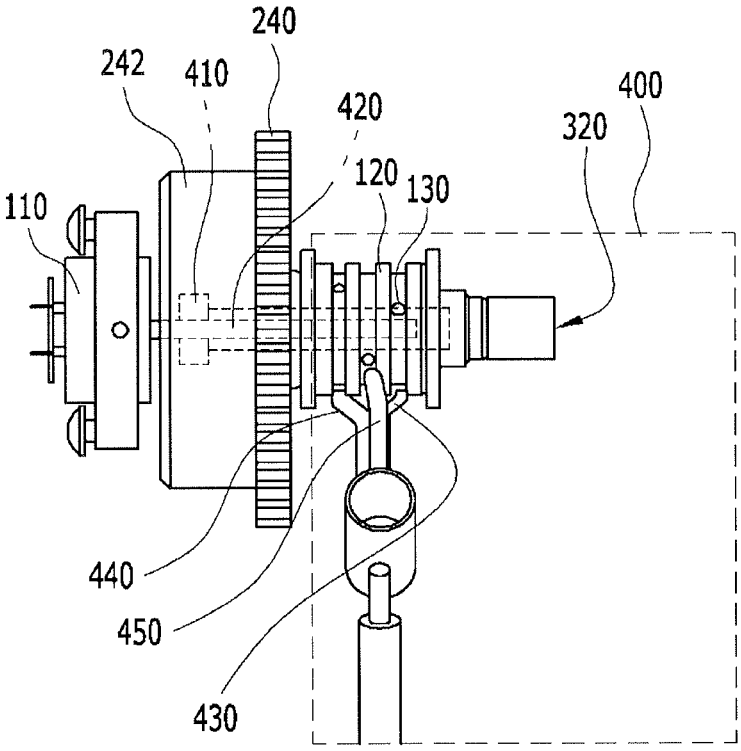
FIG. 4 is a partial side view showing the inside of an exemplary engine having a variable valve timing device according to the present invention.

FIG. 4 is a partial side view showing the inside of the engine having a variable valve timing device according to various embodiments of the present invention. Referring to FIG. 4, the variable valve timing device includes a cylinder head 400, the camshaft 320, the valve body 120, the hydraulic pressure transmission holes 130, a delay channel 440, an advance channel 450, a locking pin operation channel 430, a control spool 420, a spool bolt 410, the sprocket housing 242, the sprocket 240, and the actuator 110.

The actuator 110 is fixed to the chain cover 100 and can pull or push the control spool 420 in the valve body, using power from the outside.

The delay channel 440, advance channel 450, and locking pin operation channel 430 are formed in the cylinder head 400, such that hydraulic pressure is supplied to the delay chamber through the delay channel 440, the advance chamber through the advance channel 450, or the locking pins 200 through the locking pin operation channel 430, in accordance with the movement of the control spool 420.

In various embodiments of the present invention, as the actuator 110 moves the control spool 420 and hydraulic pressure is supplied to the advance chamber through the advance channel 450, the sprocket housing 242 and the sprocket 240 are advanced, such that the rotation of the camshaft 320 is advanced.

As the actuator moves the control spool 420 and hydraulic pressure is supplied to the delay chamber through the delay channel 440, the sprocket housing 242 and the sprocket 240 are delayed, such that the rotation of the camshaft 320 is delayed.

Further, the actuator 110 moves the control spool 420 and hydraulic pressure is supplied to locking pins 200 through the locking pin operation channel 430, the sprocket housing 242 and the sprocket 240 are fixed with the camshaft 320, at a middle position between the advance and delay positions.

When hydraulic pressure is not supplied, the sprocket housing 242 and the cam shaft 320 are unlocked and delay control and advance control are performed.

In various embodiments of the present invention, the control spool 420 is inserted in the center of the spool bolt 410 and the spool bolt 410 fixes the fixed housing 270 to the valve body 120.

Figure 5:
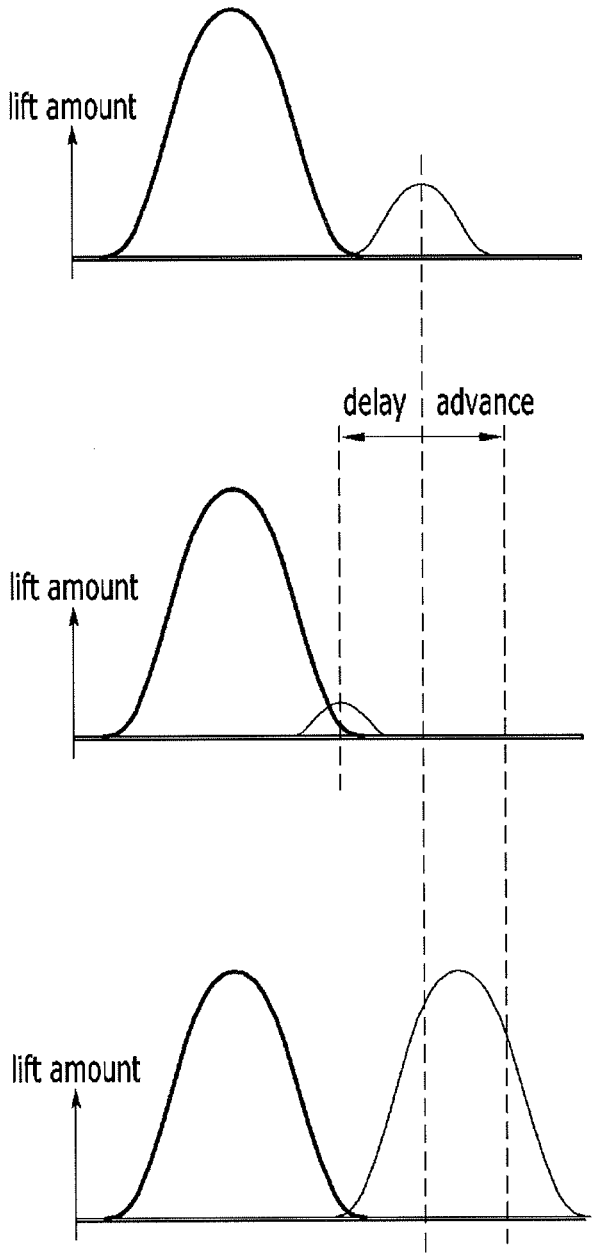
FIG. 5 is a graph showing the effect of an exemplary engine having a variable valve timing device according to the present invention.
Figure 6:
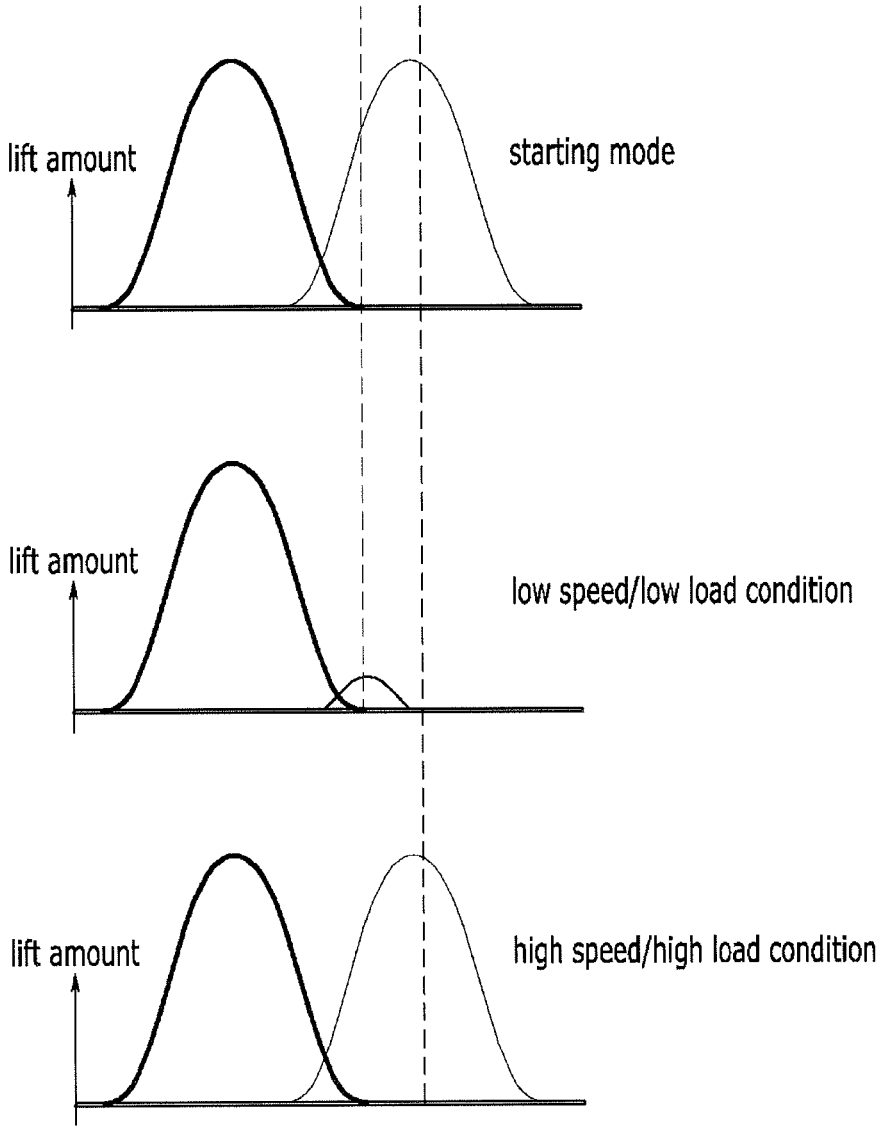
FIG. 6 (Related Art)
FIG. 6 is a graph showing a lift of a valve through a variable valve timing device.

FIG. 5 is a graph showing the effect of the engine having a variable valve timing device according to various embodiments of the present invention. Referring to FIG. 5, the lift timing of a valve may be advanced or delayed at the middle phase.

When the lift timing of the valve is advanced, the lift amount of the valve decreases, and when the lift timing of the valve is delayed, the lift amount of the valve increases. That is, in various embodiments of the present invention, the lift timing and the lift amount of a valve can be simultaneously controlled.

For convenience in explanation and accurate definition in the appended claims, the terms "inner" or "outer", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine having a variable valve timing device, comprising:

a camshaft having a cam lifting a valve;

a valve body with a first side fixed with the camshaft and a second side fixed to a fixed housing;

variable wings protruding on an outer circumferential surface of the fixed housing;

a sprocket housing including a delay chamber and an advance chamber with the variable wings and having a sprocket on an outer circumferential surface of the sprocket housing;

a control spool disposed coaxially with the camshaft and inserted in the valve body to selectively supply hydraulic pressure from an outside to the delay chamber or the advance chamber; and an actuator fastened to an outer end of the control spool, with a side fixed to a side of the engine, and advancing or delaying the sprocket housing with respect to the valve body by adjusting the hydraulic pressure supplied to the advance chamber or the delay chamber through the control spool by pulling or pushing the control spool, wherein locking pins, selectively locking the fixed housing and the sprocket housing, are disposed in the fixed housing or the sprocket housing, and wherein the actuator is fixed to a side of a chain cover protecting a chain wound around the sprocket.

2. The engine of claim 1, further comprising:

a cylinder head where the valve body is disposed, and an advance channel and a delay channel through which the hydraulic pressure is supplied to the advance chamber and the delay chamber, respectively, are formed in the cylinder head.

3. The engine of claim 1, further comprising:

a cylinder head rotatably supporting the valve body, wherein a locking pin channel through which the hydraulic pressure is transmitted to the locking pins is formed in the cylinder head and the control spool selectively transmits the hydraulic pressure to the locking pins in accordance with a position of the sprocket housing.

4. The engine of claim 3, wherein the locking pins fix the sprocket housing in a middle position between a delay position and an advance position.

5. The engine of claim 1, further comprising:

an inner cover covering a camshaft side of the sprocket housing;

an outer cover covering a side opposite to the inner cover of the sprocket housing; and an elastic member elastically supporting the sprocket housing in a delay or advance direction with respect to the outer cover.

* * * * *